US006573820B2

(12) United States Patent
Yamada et al.

(10) Patent No.: US 6,573,820 B2
(45) Date of Patent: Jun. 3, 2003

(54) INDUCTOR

(75) Inventors: Katsuo Yamada, Minato-ku (JP); Fumiaki Nakao, Minato-ku (JP); Tomoyuki Akaya, Minato-ku (JP); Satoshi Ota, Minato-ku (JP); Mikio Kitaoka, Minato-ku (JP); Yoshio Matsuo, Minato-ku (JP); Tadashi Tateno, Minato-ku (JP)

(73) Assignee: FDK Corporation, Tokyo (JP)

( * ) Notice: Subject to any disclaimer, the term of this patent is extended or adjusted under 35 U.S.C. 154(b) by 51 days.

(21) Appl. No.: 09/850,001

(22) Filed: May 8, 2001

(65) Prior Publication Data

US 2001/0043135 A1 Nov. 22, 2001

(30) Foreign Application Priority Data

May 16, 2000 (JP) ..... 2000-143389
Mar. 1, 2001 (JP) ..... 2001-056064

(51) Int. Cl.[7] ..... H01F 27/28
(52) U.S. Cl. ..... 336/184; 336/192; 336/198; 336/200
(58) Field of Search ..... 336/184, 192, 336/198, 208, 118, 200, 225, 229, 232

(56) References Cited

U.S. PATENT DOCUMENTS 4,622,526 A * 11/1986 Schneider et al. ..... 333/181
4,878,291 A * 11/1989 Suguri ..... 29/606
5,351,167 A * 9/1994 Wai et al. ..... 336/192

FOREIGN PATENT DOCUMENTS

| | | |
|---|---|---|
| JP | 63-20805 | 1/1988 |
| JP | 403253009 A * | 11/1991 |
| JP | 4-274305 | 9/1992 |
| JP | 5-243057 | 9/1993 |
| JP | 8-236361 | 9/1996 |

OTHER PUBLICATIONS

IBM Technical Disclosure Bulletin, Fabrication of High–Frequency Transormer with Programmable Windings, Aug. 1, 1983, vol. 26, pp. 1441–1445.*

* cited by examiner

*Primary Examiner*—Anh Mai
*Assistant Examiner*—Jennifer A Poker
(74) *Attorney, Agent, or Firm*—Wenderoth, Lind & Ponack, L.L.P.

(57) ABSTRACT

An inductor of the invention is obtained by forming conductors of a desired shape on bendable plate type support members, providing a slit in one end of each of the conductors, and a claw on the other end of each of the conductors, bending the plate type support members, engaging the slits and claws with each other so as to form windings on the support members and openings therein, and inserting magnetic cores through the openings.

12 Claims, 15 Drawing Sheets

INDUCTOR

BACKGROUND OF THE INVENTION

The present invention relates to an inductor for small-thickness windings, etc. used for, for example, transformers and the like.

A related art inductor is assembled generally by winding a cable wire a predetermined number of times around a bobbin, and thereafter mounting the bobbin on a magnetic core, for example, an EI core, a UI core, and a pot type core, etc.

There is also an inductor formed by laminating in a multi-layered state plural sheets on which coil patterns of conductors are formed, and electrically connecting the sheets together at end portions thereof to obtain a required number of windings as shown in Japanese Patent Publication (Unexamined) No. 4-274305/1992.

However, in this structure, the attaching and detaching of a bobbin to and from a winding machine, the winding of a cable wire around the bobbin and the mounting of the bobbin on a core require substantial labor, so that the structure has a problem concerning the productivity. In view of this, a mechanized structure suitable for mass production was proposed as shown in Japanese Patent Publication (Unexamined) No. 8-236361/1996).

A transformer-forming structure using a coil member obtained by forming a spiral conductor on a surface of a flexible insulating substrate is also known. For example, a structure disclosed in Japanese Patent Publication (Unexamined) No. 63-20805/1988 is obtained by forming spiral conductors, which constitute first and second windings, on both surfaces of a flexible insulating substrate, bending and laminating the resultant insulating substrate, and inserting an insulator while folding the same between opposed surfaces of the insulating substrate to form a coil member.

In the case of the structure disclosed in Japanese Patent Publication (Unexamined) No. 63-20805/1988, the laminating of the first and second windings in the axial direction of a magnetic core (which will hereinafter be referred to simply as core) is employed. This poses the following large problems. A flux leakage between the first and second windings and an eddy current loss occurring in the windings and surrounding structures increase, and an ill influence is exerted in many cases on a peripheral circuit.

An attempt was made to reduce leakage inductance of small-thickness windings, as shown in Japanese Patent Publication (Unexamined) No. 5-243057/1993) for solving the problems as described above.

According to the structure described above, spiral conductors constituting first and second windings are formed on a flexible insulating substrate, and this insulating substrate is bent and laminated so as to hold one winding between parts of the other. Namely, plural core inserting holes are arranged in the insulating substrate in the longitudinal direction thereof, and first and second spiral conductors constituting the first and second windings are formed on the portions of at least one surface of the insulating substrate which are around the core inserting holes. These first and second spiral conductors are connected together in series, and the insulating substrate is bent in blocks of spiral conductor, one winding being laminated on the other so as to be held between parts of the second-mentioned winding, whereby a coil member is formed.

However, since this structure is a laminated structure, there is not a degree of freedom of selecting the number of turns. Therefore, the use and performance of the structure is determined or fixed in advance, and the structure cannot be applied immediately to various other uses or applications.

Forming a winding by retaining a core by using metal clips is also known. In this method, the winding under the core is formed of a pattern on a circuit board, so that the soldering of an inner surface of the core is very difficult. Moreover, since a pattern is provided on the printed board, large limitations are placed on a design of the printed board.

In a large-sized power inductance handling a large current, a thick winding has to be put around a small core, and it is therefore difficult to manually manufacture inductors having uniform characteristics.

SUMMARY OF THE INVENTION

The present invention has been made in view of the above circumstances, and an object of the present invention is to provide a new inductor capable of eliminating the above-mentioned drawbacks encountered in the related art inductor, reducing the manday (that is, manufacturing steps) of windings, and being applied to the surface mounting techniques.

Another object of the present invention is to provide an inductor formed at a low cost and a simple construction by simplifying a winding-forming step in the production of, especially, a small-sized high power inductor.

A further object of the present invention is to provide an inductor capable of forming a winding structure by connecting conductors together in cooperation with simple slits and claws; and being manufactured easily.

According to the present invention there is provided an inductor obtained by forming conductors of a desired shape on bendable plate type support members, providing a slit in one end of each of the conductors and a claw on the other end of each of the conductors, bending the plate type support members, engaging the slits and claws with each other to form windings and provide openings in the support members, and inserting magnetic cores through the openings.

In another aspect of the present invention, there is provided an inductor obtained by forming conductors on rectangular parallelopipedal support members having openings, through which magnetic cores are inserted, between opposite surfaces of the support members with respect to one of three axial directions thereof, and engaging end portions of the conductors with each other in a plane perpendicular to the direction in which the conductors are formed, to connect the conductors to each other and thereby form windings.

Owing to this structure, it becomes possible to cover the magnetic cores with the windings provided on the support members so that the horizontal positioning of the windings and magnetic cores can be done.

In another structure of the present invention, the engaging of the conductors is done by locking together slits provided in the support members and claws provided on one end of the conductors, whereby winding structures can be formed.

It is possible to form groove-carrying bands on the support members, and operate the same bands as guides for positioning the windings and magnetic cores in the horizontal direction.

It is also possible to arbitrarily regulate the number of turns by soldering together claws provided on the support members and a mounting substrate.

In this structure, it is possible to carry out the engaging of the conductors on the outer surfaces of the magnetic cores.

It is also possible to use parts of the support members also as gap regulating sheets.

It is also possible to simultaneously carry out the positioning of the magnetic cores and a gap regulating operation by pasting gap-regulating sheets on the support members in advance.

The present invention further provides an inductor obtained by providing openings in flexible support members, forming conductors (patterns) along the openings, folding the support members along the openings to form windings, and putting together the openings of the folded support members to enable magnetic cores to be inserted therethrough.

In this structure, it is possible to arbitrarily increase the number of turns by folding the support members at the portions thereof, which are located between adjacent openings.

In this structure, it is possible to reduce a height of upper surfaces of turns by folding the support members at the portions thereof, which are located between adjacent openings along edges thereof.

In this structure, it is possible to carry out the positioning of the windings and magnetic cores by providing cut and raised openings in both side portions of the support members.

In this structure, it is possible to carry out the horizontal positioning of the windings and magnetic cores by providing a pair of opposed groove-carrying bands on the support members and engaging these bands with each other.

According to an aspect of the present invention, the inductor is obtained by forming conductors of a desired shape on bendable plate type support members, providing a slit in one end of each of the conductors, and a claw on the other end of each of the conductors, folding the plate type support members, engaging the slits and claws with each other to form windings on and openings in the support members, and inserting magnetic cores through the openings. Therefore, a winding forming step for, especially, a small-sized high power inductor can be simplified greatly. This enables the cost to be reduced, and the inductor to be applied very easily to surface mounting techniques.

According to another aspect of the present invention, the inductor is characterized by forming conductors on rectangular parallelopipedal support members provided with openings, through which magnetic cores are inserted, between opposite surfaces of the support members with respect to one of three axial directions thereof, and engaging end portions of the conductors with each other in a plane perpendicular to the direction in which the conductors are formed, to connect the conductors together and thereby form windings. Therefore, a winding forming step for, especially, a small-sized high power inductor can be simplified in the same manner as mentioned in the above case. This enables the cost to be reduced, and the inductor to be applied very easily to surface mounting techniques.

Besides these inductors, a structure in which the windings provided on the support members cover the magnetic cores is capable of carrying out the horizontal positioning of the windings and magnetic cores, and attaining this positioning operation very easily.

Since winding structures are formed by engaging the conductors with each other by locking together the slits provided in the support members and the claws provided at one end of the conductors, the engagement of the conductors can be attained by a very simple structure.

The groove-carrying bands are formed on the support members and operated as guides for horizontally positioning the windings and magnetic cores, so that the positioning of these parts can be done easily.

The number of turns can be regulated arbitrarily by soldering together the claws provided on the support members and a mounting substrate.

Since the engaging of the conductors with each other is done on outer surfaces of the magnetic cores, the assembling work for the manufacturing of the conductor can be carried out easily.

Since parts of the support members are used also as gap regulating sheets, the construction of the inductor can be simplified.

In a structure in which gap-regulating sheets are pasted in advance on the support members, the magnetic core positioning operation and gap-regulating operation can be carried out simultaneously.

According to still another aspect of the present invention, the inductor is obtained by providing openings in flexible support members, forming conductors (patterns) along the openings, folding the support members along the openings to form windings, and putting together the openings of the folded support members to enable magnetic cores to be inserted therethrough. This structure enables an inductor of a simple construction having a high degree of freedom of selecting the number of turns, and an adaptability to surface mounting techniques to be formed.

In this structure in which the support members are folded at the portions between adjacent openings, the number of turns can be arbitrarily increased.

In a structure in which the support members are folded at the portions thereof that are between adjacent holes along edges thereof, a height of upper surfaces of the turns can be reduced.

Providing cut and raised openings in both side portions of the support members enables the positioning of the windings and magnetic cores to be done.

In a structure in which a pair of opposed groove-carrying bands are provided on the support members, the horizontal positioning of the windings and magnetic cores can be attained simply by engaging the groove-carrying bands with each other.

BRIEF DESCRIPTION OF THE DRAWINGS

FIGS. 14A, 14B and 14C are illustrations showing assembly steps of an inductor according to a further embodiment of the invention wherein FIG. 14A shows a step for unification of the support member and the conductive pattern, FIG. 14B shows a bending step of the extended portions of the support member, and FIG. 14C shows a welding step.

FIGS. 15A through 15D show the structure of the inductor shown in FIGS. 14A to 14C, wherein FIG. 15A is a bottom view, FIG. 15B a upper plan view, FIG. 15C a sectional view taken along A—A in FIG. 15B, and FIG. 15D a sectional view taken along B—B in FIG. 15B.

PREFERRED EMBODIMENTS OF THE INVENTION

Figure 1:
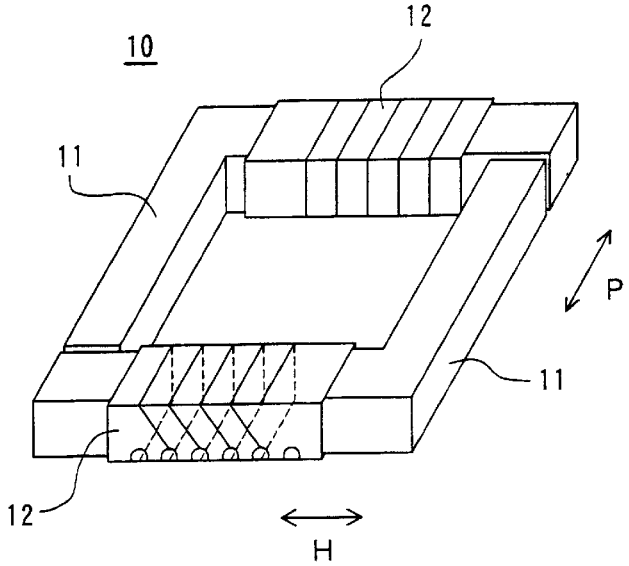
FIG. 1 is a perspective view showing the construction of the inductor according to the present invention.
Figure 7:
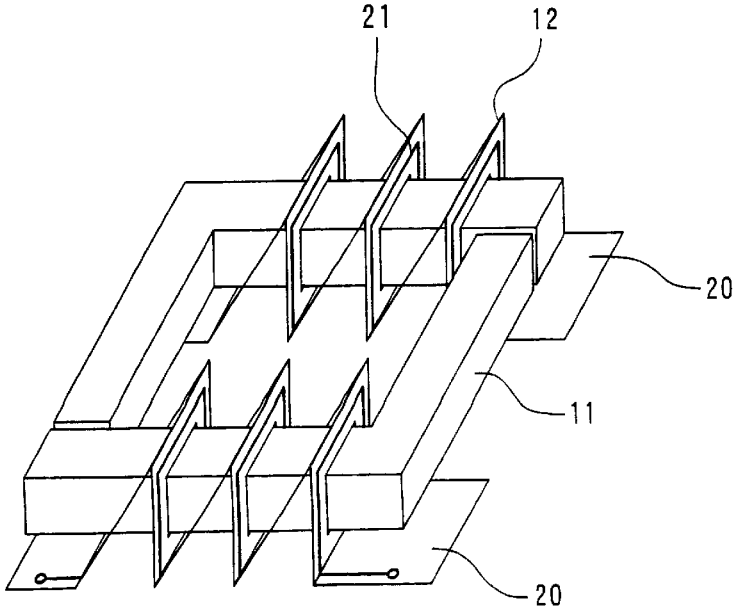
FIG. 7 is a perspective view showing the construction of still another embodiment of the inductor according to the present invention.
Figure 2A:
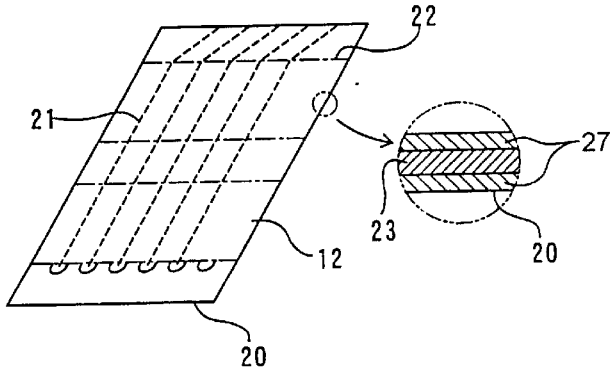
FIGS. 2A, 2B and 2C are perspective views showing the construction of and a method of forming the inductor according to the present invention.
Figure 2B:
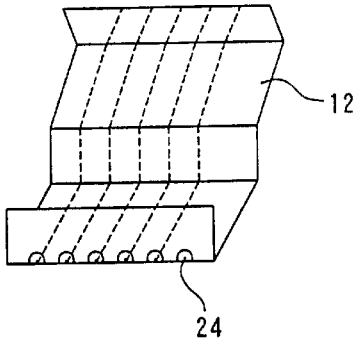
Figure 2C:
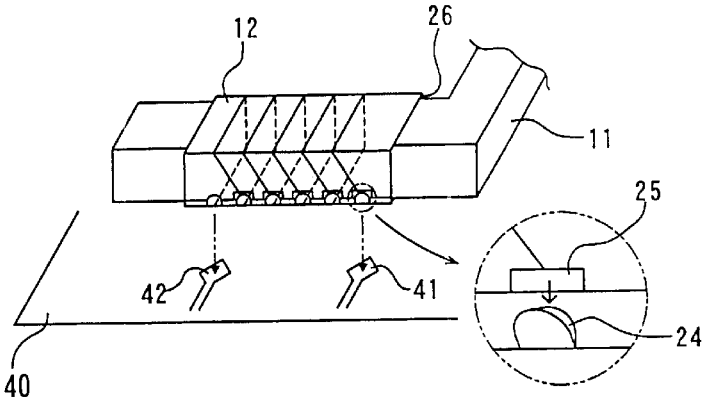

Referring first to FIG. 1 showing an external appearance of the inductor according to the present invention, and FIGS. 2A to 2C showing an engaging and connecting method for forming this inductor by providing conductors 21 on foldable support members 20, and combining the resultant products with magnetic cores 11, a pair of L-shaped or otherwise-shaped magnetic cores 11, 11 are combined with each other as shown in the drawings, to obtain a rectangular parallelopipedal structure extending in the longitudinal direction P and horizontal direction H, in which winding portions 12, 12 are formed on opposite horizontal H parts. This is an outline of a construction example of the inductor to which the present invention is directed.

Each of the winding portions 12 is obtained by forming a predetermined conductor pattern 21 on a foldable support member 20 as shown in FIGS. 2A to 2C, and providing fold lines 22 in predetermined positions on the support member so that the support member can be folded in accordance with the sizes of the magnetic core 11. The support member 20 preferably has a 3-layer structure as shown in FIG. 2A, in which a conductor 23 (for example, 0.1 mm thick) is coated at both surfaces thereof with polyimide layers 27 (for example, both upper and lower layers are 25–100 $\mu$m thick). Each of the conductor patterns 21 formed on the support members 20 is provided at one end thereof with a slit 24 as shown in FIG. 2B, and at the other end thereof with a claw 25 as shown in FIG. 2C. The slit 24 and claw 25 are engaged with each other when the support member is bent to form a winding portion of a parallelopipedal tunnel-like structure having an opening 26.

An L-shaped core 11 is inserted as shown in FIG. 2C, at a leg portion thereof through the opening 26 of the support member 20 thus folded. What is formed in this manner is a structure shown in FIG. 1. In this structure, the shape and sizes of the magnetic cores and a combination of the magnetic cores and support members can, of course, be selected suitably in accordance with the use thereof.

Figure 3A:
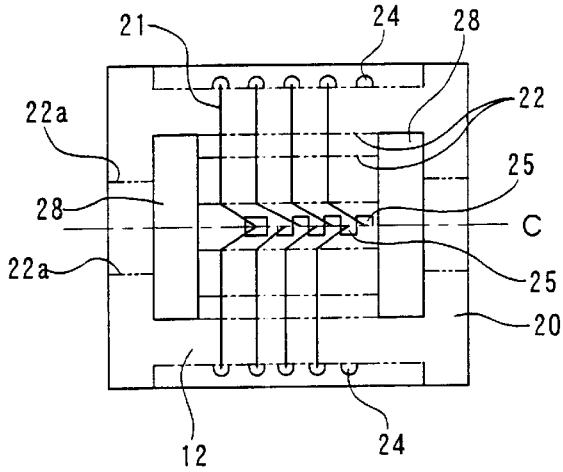
FIGS. 3A, 3B and 3C are diagrams showing the construction of and a method of forming another embodiment of the inductor according to the present invention.
Figure 3B:
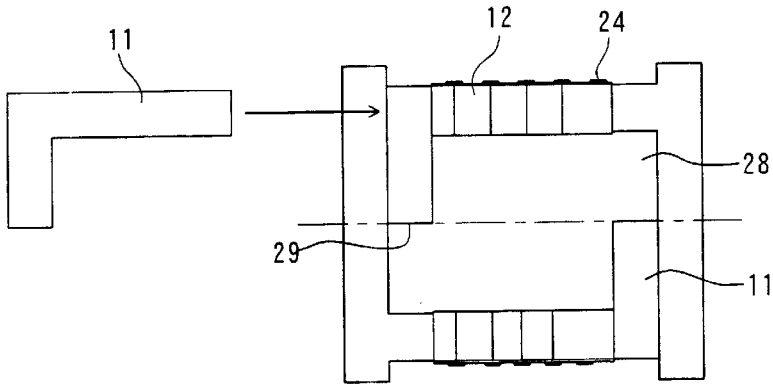
Figure 3C:
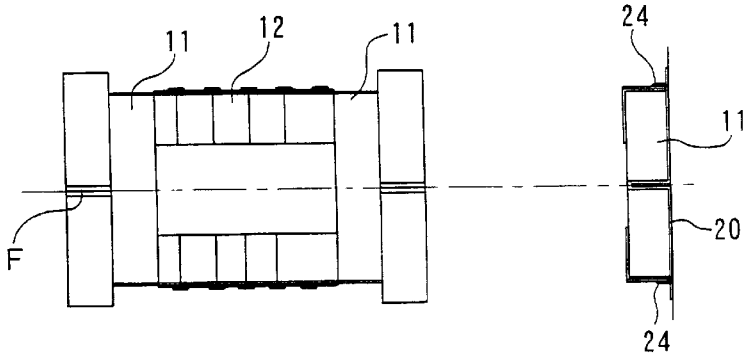

FIGS. 3A to 3C show an example of the formation of a support member 20 having conductor patterns 21 thereon.

Referring to FIG. 3A, a structure having a conductor pattern 21 on a support member 20 is formed on upper and lower sides of a center line C as illustrated, and these products are used as a pair of opposite winding portions (reference numerals 12, 12 in FIG. 1). Slits 24 are formed in end portions (upper and lower portions of the support member) of the conductor patterns 21, and claws 25 at the opposite side (i.e. a central portion of the drawing). Openings 28, 28 are formed in opposite side portions of the conductor patterns 21. The support member is bent along fold lines 22 and center line C so that fold lines 22*a*, 22*a* near the center line C are opposed to and brought close to each other. The support member is bent along the respective fold lines with the center line C as a border line, to form two (one set of) winding portions 12, 12 in opposite positions. The L-shaped cores 11, 11 are inserted, as shown in FIG. 3B, through the openings of the winding portions 12, 12 thus formed. In this case, it is necessary that the support member 20 be folded until the cores 11 and positioning walls 29 contact each other. Thus the support member 20 is folded (a reference character F indicates folded portions) at a central portion as shown in FIG. 3C, to fix the magnetic cores 11 in the lateral direction (horizontal direction).

The magnetic cores are thus covered with the winding portions formed by the support member, and this enables the horizontal positioning of the windings and cores to be done.

Figure 4A:
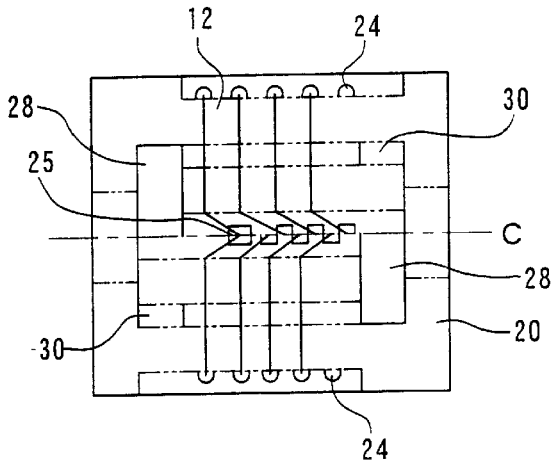
FIGS. 4A, 4B and 4C are diagrams showing the construction of and a method of forming still another embodiment of the inductor according to the present invention.
Figure 4B:
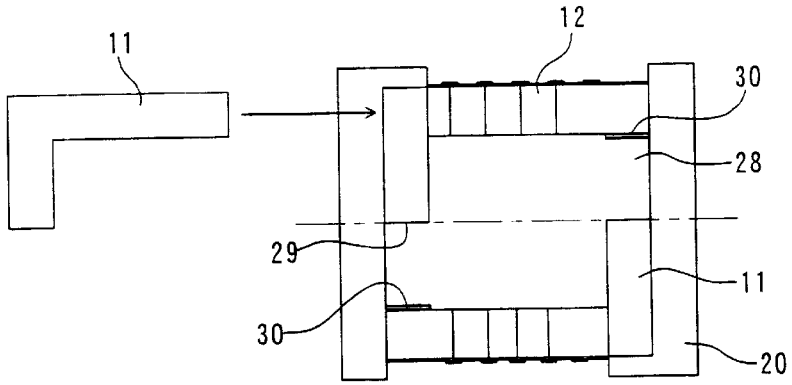
Figure 4C:
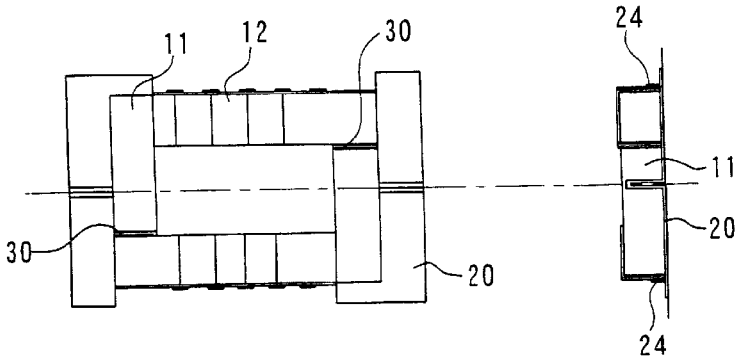

FIGS. 4A to 4C show an embodiment in which gap regulating sheets are pasted on a support member to enable a core positioning operation and a gap regulating operation to be carried out simultaneously.

In this embodiment, gap regulating sheets 30 formed in advance are pasted on diagonally opposite portions of a support member 20 instead of forming openings therein, with openings 28 left in the other diagonally opposite portions thereof in the same manner as in the embodiment of FIGS. 3A to 3C. Cores are inserted through winding portions 12 thus formed, in such a manner as shown in FIGS. 4B and 4C, whereby positioning walls 29 formed in a central portion of the support member and gap regulating sheets 30 enable the core positioning operation and gap regulating operation to be carried out simultaneously. Namely, covering the cores 11 with the winding portions provided on the support member 20 enables the attainment of the horizontal positioning of the windings 12 and cores 11. Pasting gap regulating sheets 30 on the support member 20 in advance enables not only a core positioning operation but also an operation for regulating gaps of cores to be carried out at once.

Figure 5A:
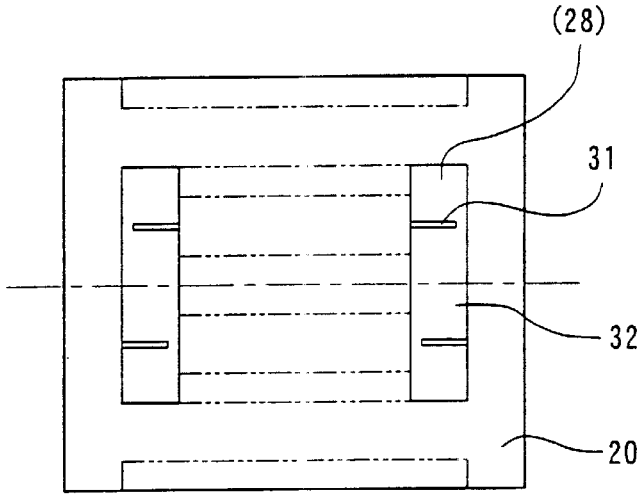
FIGS. 5A and 5B are diagrams showing a further embodiment of the present invention.
Figure 5B:
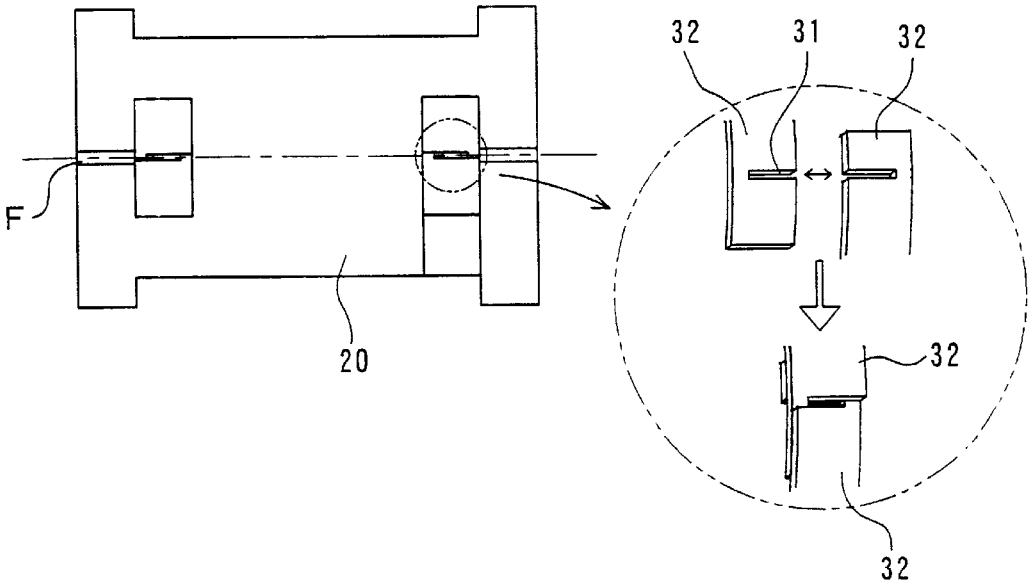

FIGS. 5A and 5B show an embodiment in which groove-carrying bands 31 are provided in an opposed state on a support member 20, whereby the windings 12 and cores 11 can be vertically positioned.

Namely, instead of the openings of the embodiment of FIGS. 3A to 3C, a pair of cut and raised type openings 28 are formed, and these parts are used as bands 32, in each of which grooves 31 are formed to carry out the vertical (direction of a reference character P in FIG. 1) positioning of the windings and cores. In this case, as shown on an enlarged scale in FIG. 5B, one of the grooves 31 of one of the groove-carrying bands 32 is cut from an inner side, and the other thereof from the opposite side, while the grooves of the other groove-carrying band to be engaged with the first-mentioned band are cut from the sides contrary to those in the case of the first-mentioned band. Owing to this arrangement, the bands 32, 32 are engaged with each other to enable the windings and cores to be vertically positioned. Referring to FIG. 5B, a reference character F denotes folded portions of the support member 20 folded along a center line thereof. The construction of the remaining portions is identical with that of the corresponding portions of the above-described embodiments.

Figure 6A:
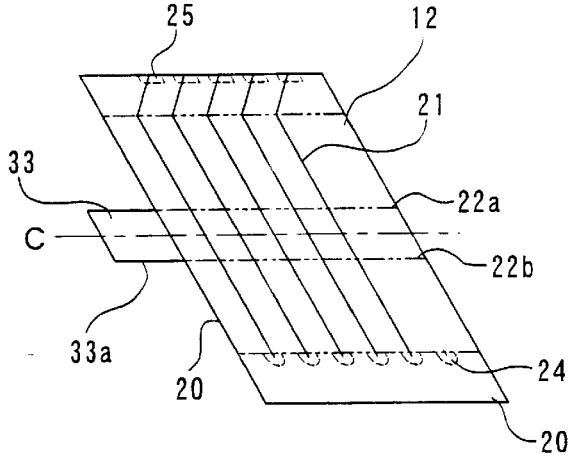
FIGS. 6A, 6B and 6C are diagrams showing the construction of and a method of forming another embodiment of the inductor according to the present invention.
Figure 6B:
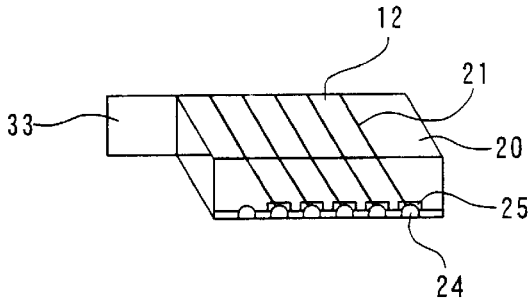
Figure 6C:
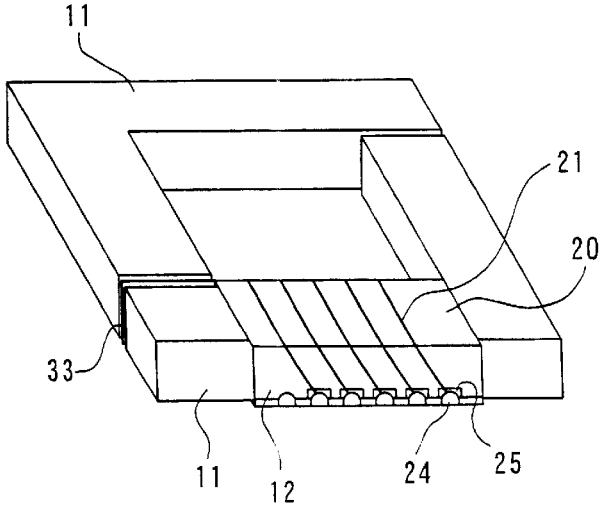

FIGS. 6A, 6B and 6C show a structure in which a part of a support member 20 is used also as a gap-regulating sheet.

Referring to FIG. 6A, a structure in which conductor patterns 21 provided at the opposite end portions thereof with claws 25 and slits 24 are formed on the support member 20 is identical with those of the above-described embodiments. In the embodiment of FIGS. 6A to 6C, fold lines 22*a*, 22*b* on the upper and lower sides of a center line C of the support member 20 are extended to form an extensional portion 33 integral with the support member 20. The extensional portion is formed so that it is positioned in a gap between opposed, L-shaped cores when an inductor is assembled as shown in FIGS. 6B and 6C, to enable the gap to be regulated. A difference between this extensional portion and the gap regulating sheets 30 of the embodiment of FIGS. 4A to 4C resides in the following. In the structure of FIGS. 4A to 4C, the gap regulating sheets 30 formed separately in advance are pasted on the support member 20, while the extensional portion of the embodiment of FIGS. 6A to 6C is made integral with the support member 20 by extending a part thereof.

The gap regulating sheet 33 thus made integral with the support member 20 is positioned between opposed portions of L-shaped magnetic cores 11 disposed so as to face each other as shown in FIG. 6C, the gap regulating sheet 33 working so as to regulate the gap between the cores. Namely, in this embodiment, a part of the support member 20 is extended to form the extensional portion as the gap-regulating sheet 33.

FIG. 7 and FIGS. 8A, 8B and 8C show a further embodiment of the present invention.

In this embodiment, an inductor is formed by providing openings 28 in a flexible support member 20, forming a conductor (pattern) 21 along these openings 28, folding the support member 20 along the openings 28 to form a winding, and putting together the openings 28 of the folded support member 20 so that a magnetic core 11 can be inserted therethrough. In this structure, the number of turns can be increased to a desired level by folding the support member at the portions thereof which are between adjacent openings 28.

Figure 8A:
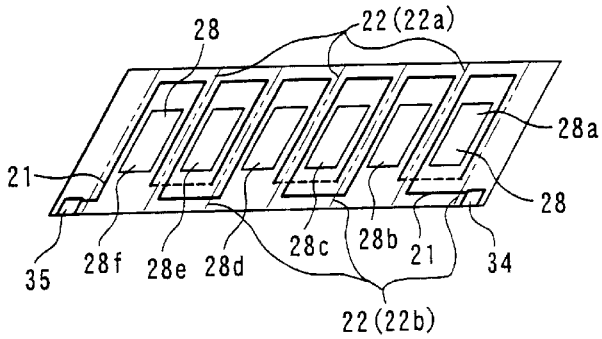
FIGS. 8A, 8B and 8C are diagrams showing the construction of and a method of forming the embodiment of FIG. 7 of the inductor according to the present invention.
Figure 8B:
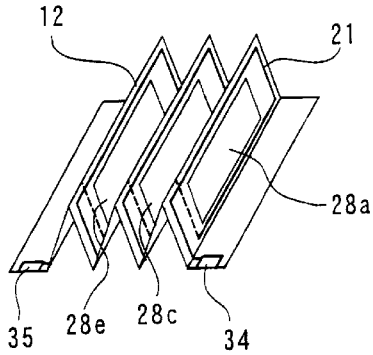
Figure 8C:
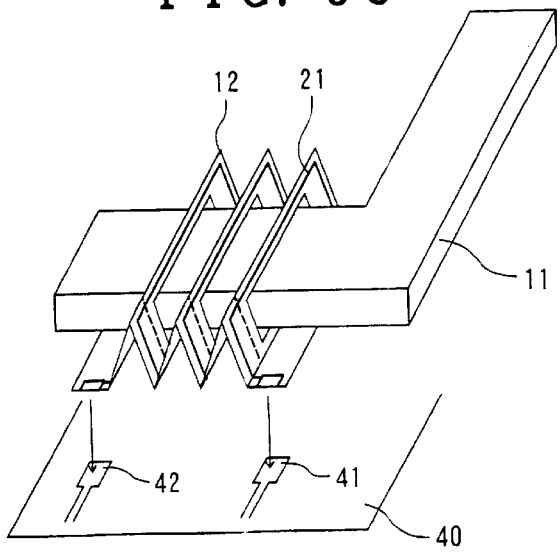
Figure 9:
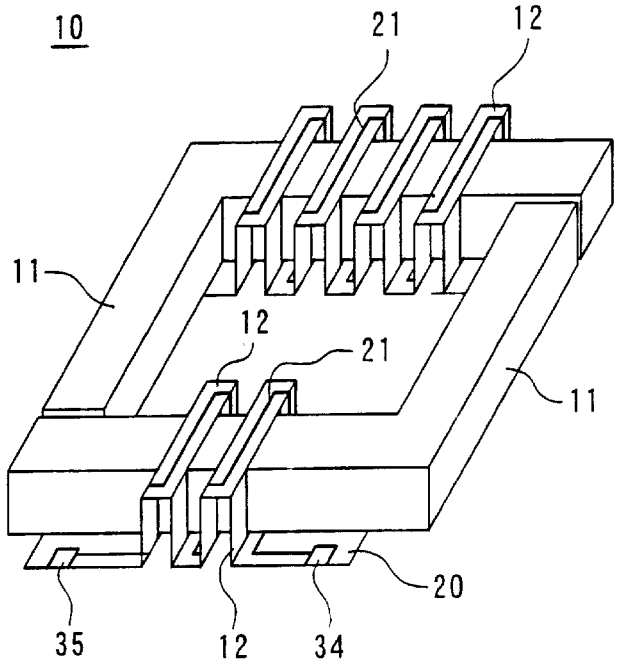
FIG. 9 is a perspective view showing a modified example of the inductor of FIG. 7.

Namely, as shown in assembling drawings of FIGS. 8A, 8B and 8C, a plurality of openings 28 are formed in parallel with each other at predetermined intervals in the flexible support member 20, and a conductive pattern 21 is provided along the openings 28. Between adjacent openings, fold lines 22 that will be described presently are formed.

Referring to FIGS. 8A and 8B, the conductive pattern 2 us a conductor connecting together a solder pad 34 at a right end of each of the drawings and a solder pad 35 at a left end thereof. Around an extreme right (first) opening 28*a* of FIG. 8A, the conductor substantially surrounds a circumference thereof and extends to a rear surface of the support member via a through hole, and then to a left adjacent (second) opening 28*b* as shown by the dotted line. Around the second opening 28*b*, the conductor rises to a front surface of the support member via another through hole, and extends round the same opening 28*b* as shown in the drawings, and then to an adjacent third opening 28*c*. The conductor then substantially makes a round of this opening via another through hole, and extends to the rear surface of the support member. The conductor further extends to the front surface near an adjacent fourth opening 28*d* via another through hole as shown in a dotted line. Thus, the conductor extends to the rear surface of the support member with respect to alternate openings, and returns to the front surface thereof with respect to the openings adjacent to these openings. The conductor extends from the next fifth opening 28*e* to the rear surface near a final opening 28*f* via another through hole, and rises to the front surface near the same opening 28*f*, the conductor then substantially surrounds the final opening 28*f* to be joined to the solder pad 35. Namely, the conductor pattern 21 extends to the rear surface of the support member with respect to alternate adjacent openings via the through holes to form a winding 12.

The fold lines 22 are formed as described above between adjacent openings 28 of the support member 20, and include upwardly foldable fold lines 22*a* and downwardly foldable fold lines 22*b* arranged alternately. A structure formed by folding the support member along these fold lines is shown in FIG. 8B. A magnetic core 11 is inserted (FIG. 8C) through the plural adjacent openings 28*a*–28*f* thus formed, in the direction of an arrow in FIG. 8B. The assembling of the winding through which the magnetic core 11 is inserted as shown in FIG. 8C is completed by connecting the solder pads 34, 35 to wiring patterns 41, 42 respectively on a printed board 40.

FIGS. 9, 10A, 10B and 10C show another embodiment of the present invention.

In this embodiment, a support member 20 is folded not by carrying out upward and downward bending operations alternately but by folding a support member along end portions of openings 28 thereof so as to form end surfaces 20*a* at folded and projecting end portions of the support member, so that a conductor pattern 21 is provided on the end surfaces. Owing to this structure, a height of an upper surface of a winding 12 can be reduced.

Figure 10A:
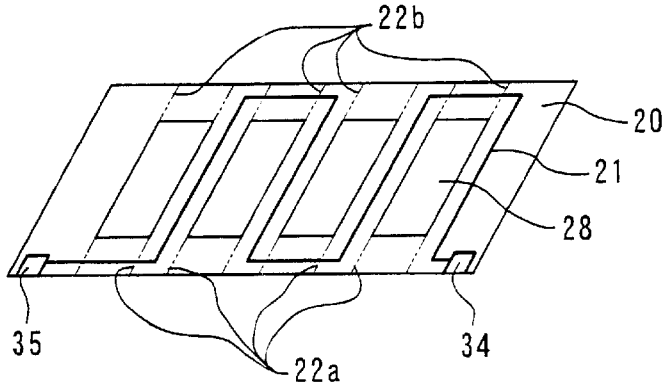
FIGS. 10A, 10B and 10C are diagrams showing the construction of and a method of forming the inductor of FIG. 9.
Figure 10B:
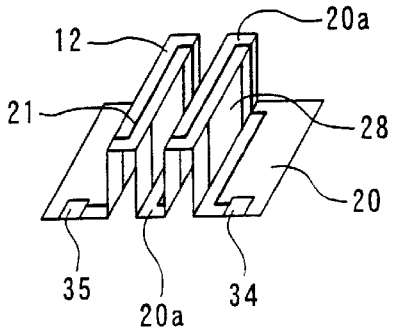
Figure 10C:
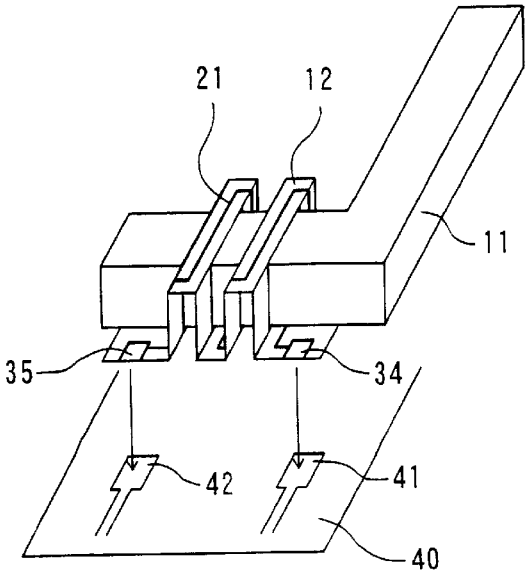

FIGS. 10A, 10B and 10C are illustrations showing an assembly procedure of an inductor of the above-described construction. In the drawing, a plurality of openings 28 are provided in a support member 20, and a conductor pattern is formed zigzag around these openings. Fold lines are provided on the portions of the support member 20 which are on extension lines of longer sides of the openings 28, as upwardly foldable fold lines 22*a* and downwardly foldable fold lines 22*b* as shown in the drawing. A magnetic core 11 is inserted (FIG. 10C) through the openings 28 of the winding 12 thus formed by folding the support member. Referring to the drawing, reference numerals 34, 35 denote solder pads, and 41, 42 wiring patterns on a printed board, which are connected to the solder pads. According to this embodiment, the height of the upper surface of the winding 12 can be held down to a low level. The construction of the remaining portions of this embodiment is identical with that of the corresponding portions of the above-described embodiment, and a description thereof will therefore be omitted.

Figure 11A:
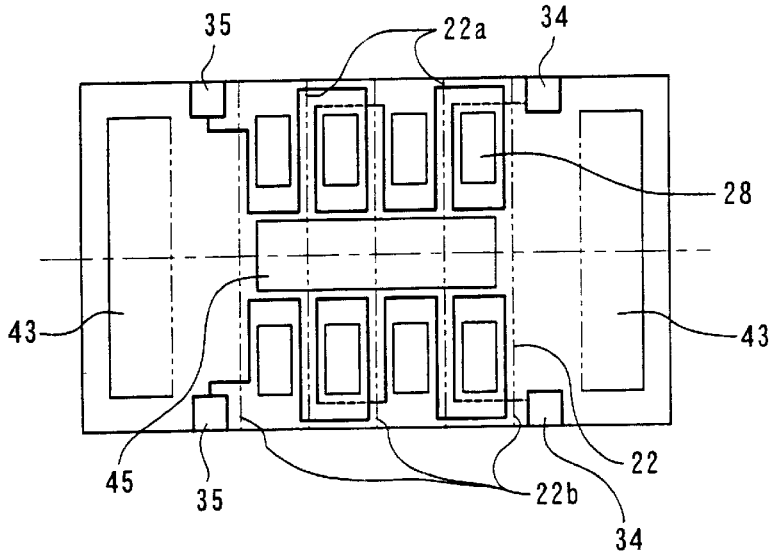
FIGS. 11A, 11B and 11C are diagrams showing the construction of and a method of forming still another embodiment of the inductor according to the present invention.
Figure 11B:
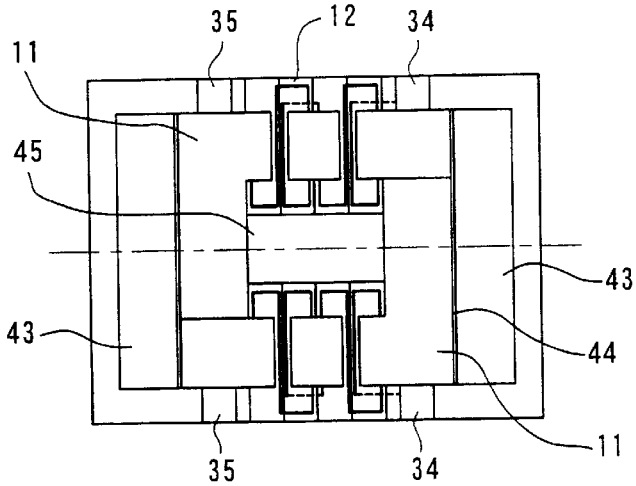

FIG. 11 shows a modified example of the structure of FIGS. 9 and 10A to 10C for reducing the height of the upper surface of a winding by folding the support member at the portions thereof which are between adjacent openings 28. In the modified example, cut and raised openings 43, 43 are formed at both side portions of a support member 20 as shown in the drawing, and used as positioning walls 44 for a magnetic core 11 as shown in FIG. 11B. This enables the positioning of a winding and core to be done. Referring to the drawing, a reference numeral 45 denotes a cutout opening. The support member is folded along the fold lines 22 including the upwardly foldable fold lines 22*a* and downwardly foldable fold lines 22*b* to form the structure of FIG. 11B.

Figure 11C:
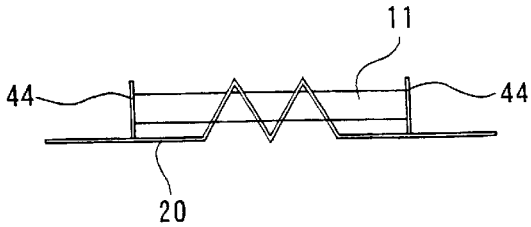
Figure 12A:
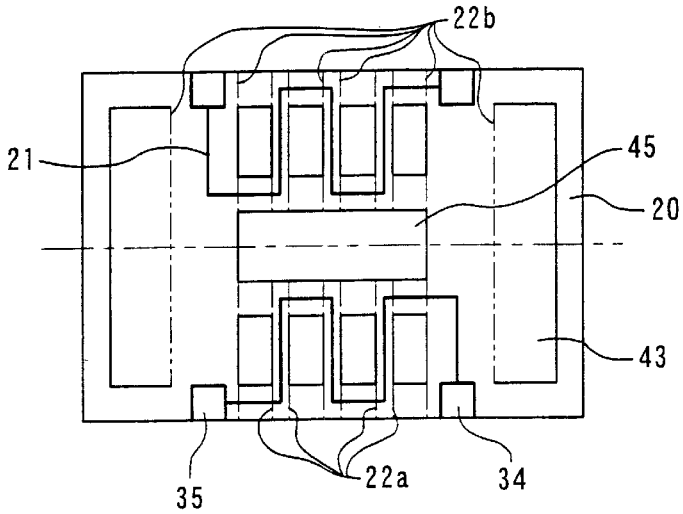
FIGS. 12A, 12B and 12C are diagrams showing the construction of and a method of forming a further embodiment of the inductor according to the present invention.
Figure 12B:
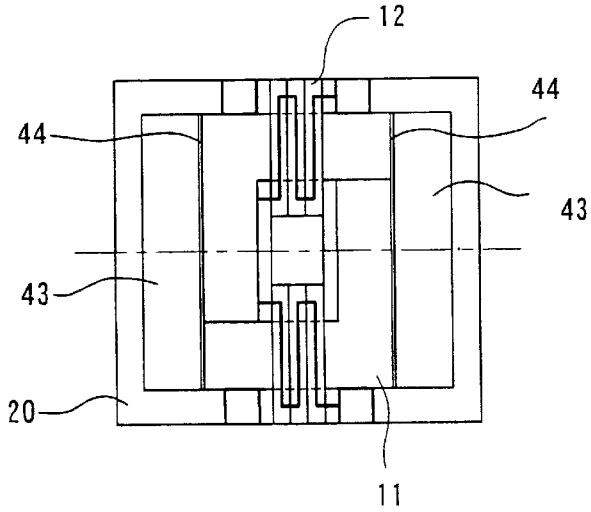
Figure 12C:
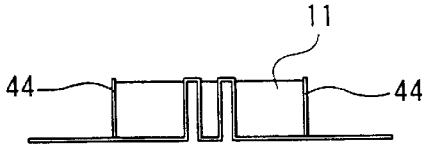

FIGS. 12A, 12B and 12C show a modified example of the structure of FIGS. 11A to 11C. In the structure of FIGS. 11A to 11C upwardly foldable fold lines 22*a* and downwardly foldable fold lines 22*b* are provided alternately on the basis of a structure in which a support member is folded at the portions thereof which are between openings as mentioned above. By contrast, a folding method used in the example of FIGS. 12A to 12C is based on those used in the previous embodiments of FIGS. 10A to 10C and FIGS. 11A to 11C, i.e. methods of folding a support member along edges of openings 28 thereof. In this basic structure, cores 11 are positioned with respect to windings 12 by positioning walls 44 formed by cutout openings 43. Since the construction of the remaining portions of the example is clear from the descriptions of the above embodiments, a detailed description thereof will be omitted with reference numerals only added.

Figure 13A:
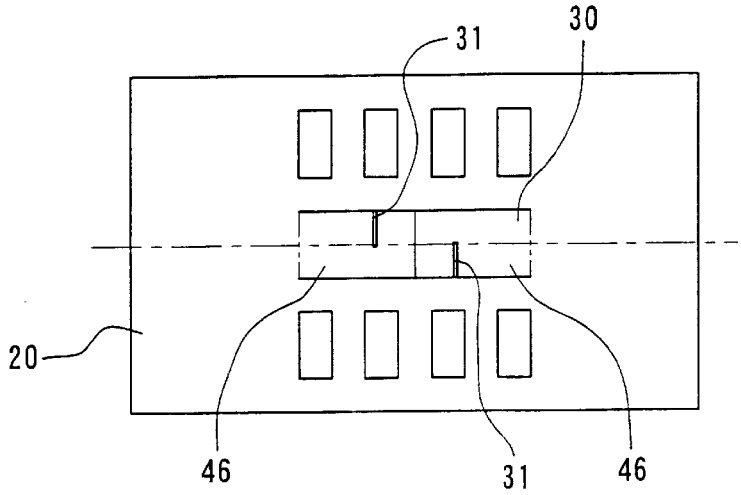
FIGS. 13A and 13B are diagrams showing another embodiment formed by modifying parts of the inductors shown in FIGS. 12A and 12B.
Figure 13B:
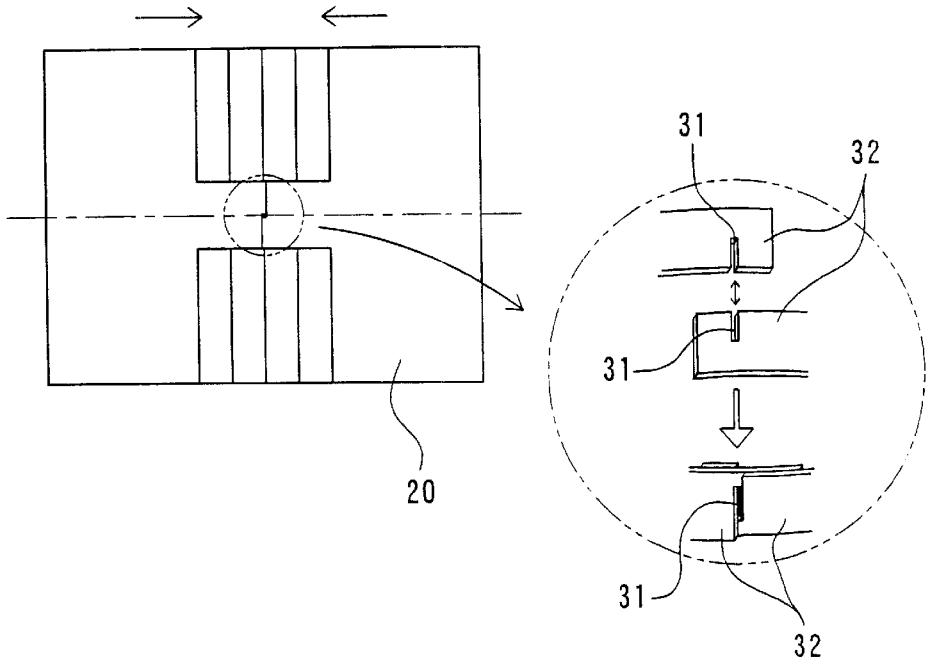

In the embodiments of FIGS. 11A, 11B, 11C and FIGS. 12A, 12*b* and 12C, the cutout opening 45 is made in the central portion of the support member 20. Instead of this structure, a pair of cut and raised openings 46, 46 may be formed as shown in FIGS. 13A, 13B and 13C so as to be used as bands 30 (corresponding to the bands 32 of FIGS. 5A and 5B), in both of which cut grooves 31, 31 are formed. When the support member is folded from left and right sides thereof toward the central portion thereof as shown by arrows, the bands mentioned above can be engaged with each other at these grooves 31, 31.

Figure 14A:
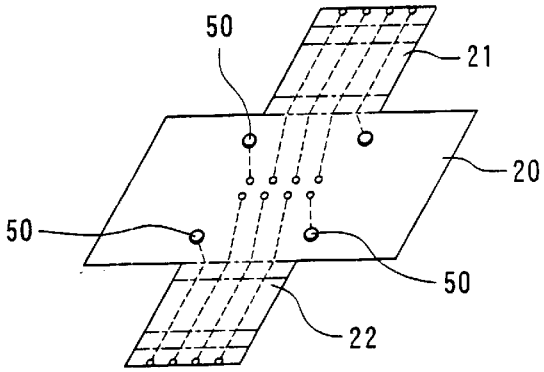
Figure 14B:
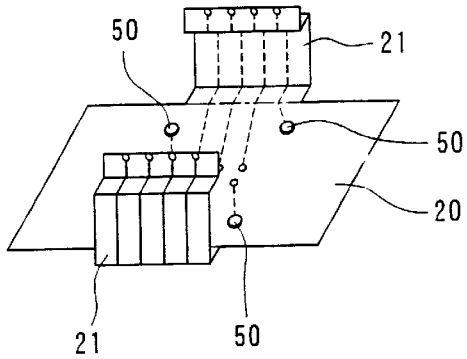
Figure 14C:
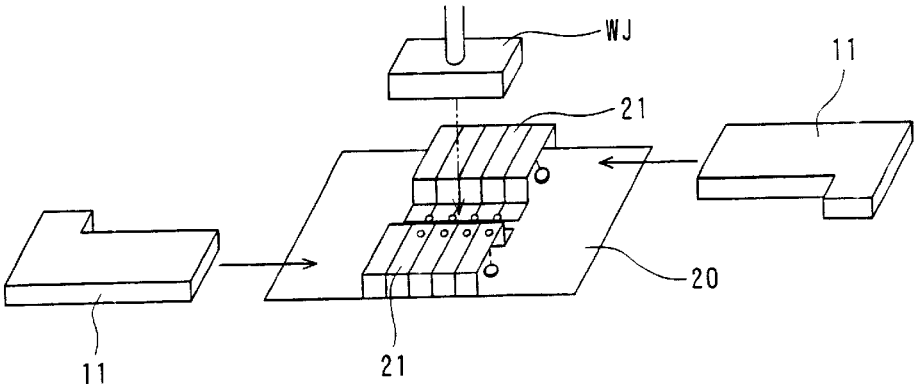

FIGS. 14A, 14B AND 14C, and 15 show a further embodiment of the present invention. In FIGS. 14A, 14B and 14C which show the steps of production, a bendable support member 20 and a conductive pattern members 21 are formed in a unitary structure. The support member 20 has opposed, extended portions 20*a* having therein conductive patterns 21 and folding lines at predetermined portions so that the extended portions can be bent or folded along the folding lines. The support member 20 has projections which are connected with the conductive patterns 21.

As illustrated in FIG. 14B, the extended portions 20*a* of the support member 20 are bent toward a center of the support member 20 along the folding lines 22 so that pad portions of ends of the extended portions 20*a* are positioned in a predetermined posture. Then, as shown in FIG. 14C, a welding jig WJ is used to connect the pad portion of the extended portion 20*a* with a connecting portion (specifically, the projection 50 for welding) of the central portion of the support member 20. The thus formed tunnel-like winding receives therein cores 11 which are L-shaped in the illustrated embodiment. If necessary, however, it should be appreciated that various types of cores such as so-called UI cores can be used as desired.

Figure 15A:
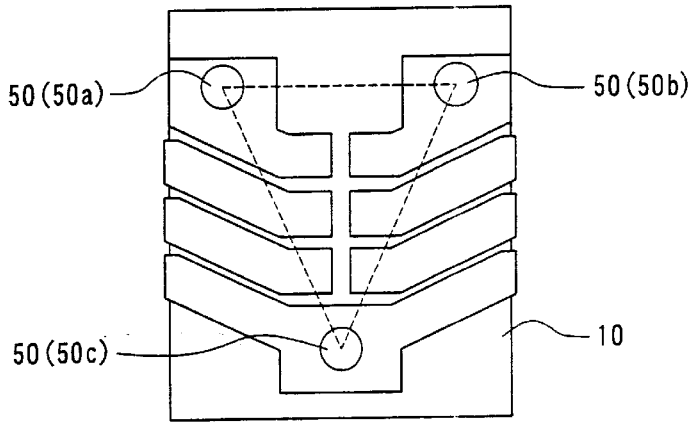
Figure 15B:
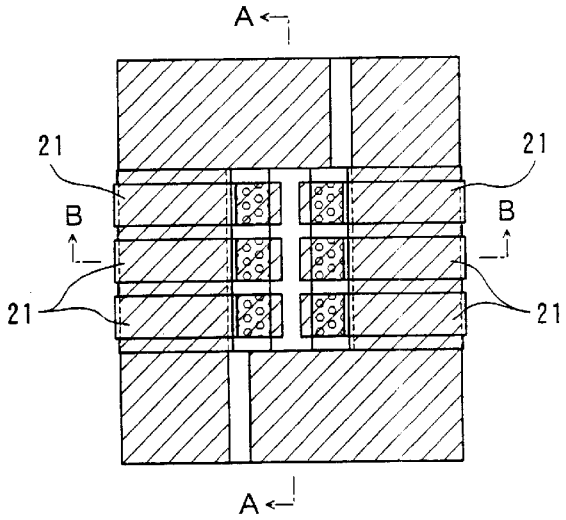
Figure 15C:
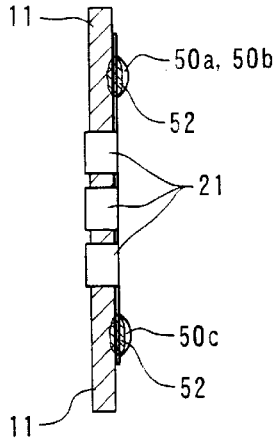
Figure 15D:
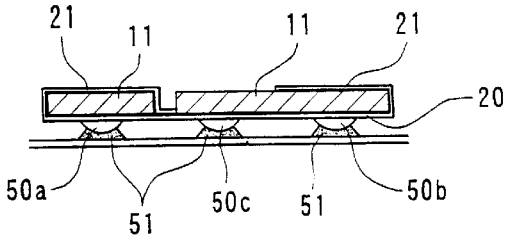

FIGS. 15A, 15B and 15C, which are a bottom view, an upper view and a side view, respectively, of an inductor which is produced as described above. As illustrated, the connection between the conductors is carried out at a space or area which is confined by the paired cores, that is, the two L-shaped cores, for example. The connection of the conductors can be made by selecting suitable method such as soldering, ultrasonic welding, etc.

Projections 50 are formed on the conductor so that soldering with the printed circuit board 40 can be conducted through the projections 50 and this facilitates and meets with the surface mounting requirements. Here, reference numeral 51 in FIG. 15C represents solder that serves to couple the projections 50 with the printed circuit board 40 and 52 an adhesive for fixing the cores 11 in position.

The projections 50 can be formed by welding a metal leaf to the conductive pattern 21 or by indenting the conductive patter 21. When a metal leaf is used for welding to provide the projections 50, it is advantageous to provide a predetermined shape of the projections although the number of production steps is increased. On the other hand, the indentation method described above has advantages that formation of the projections 50 can be integrally formed at the same time of the bending work and the cores and the windings can be fixed easily and effectively together by providing an adhesive agent into the recess which is formed by the indentation, although there is a shortcoming of restriction in selection of the shape.

In FIG. 14A four projections 50 are shown, but in a preferred embodiment three projections 50 are provided at the portions 50*a*, 50*b*, 50*c* in such a manner that a center of gravity of a triangle which is formed by connecting the three projections 50 at the three points 50*a*, 50*b*, 50*c* becomes coincident with the center of gravity of the inductor itself. This structure enhances to minimize a distortion of the conductive patterns on the support member 20 and its harmful influences.

In FIG. 15A, if the projections 50*a* and 50*b* are connected together and connected with the circuit relative to the projection 50*c*, the two windings are connected in a parallel connection. This will be able to increase an current allowance of the windings. If, on the other hand, the circuit is connected between the projection 50*a* and the projection 50*b*, the two windings are connected in a series connection, so that the windings can be doubled.

As described above, in the embodiment of FIGS. 14A through 15D, the number of winding steps can be reduced and this structure can be in conformity with surface mounting. Particularly, with respect to a power inductor of a reduced-height type, the winding process can be simplified and consequently a reduction of production cost can be attained. In addition, the structure can readily meet with the requirements for surface mounting.

Figure 16A:
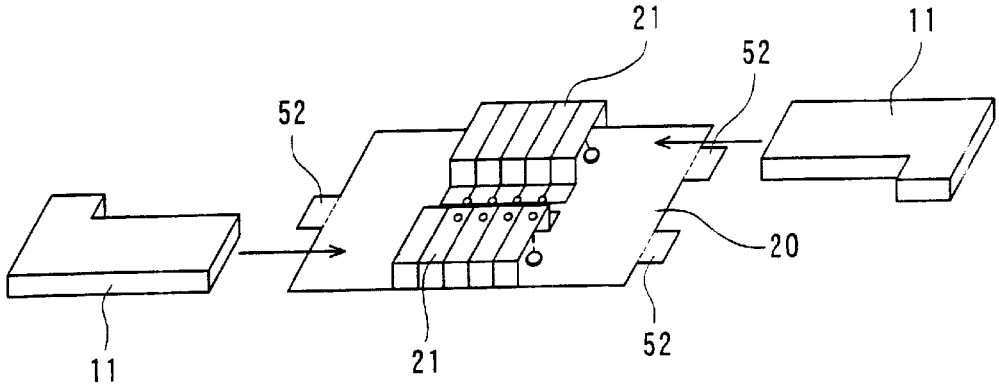
FIGS. 16A and 16B are explanatory perspective view and side view, respectively, of an inductor according to a further embodiment of the invention.
Figure 16B:
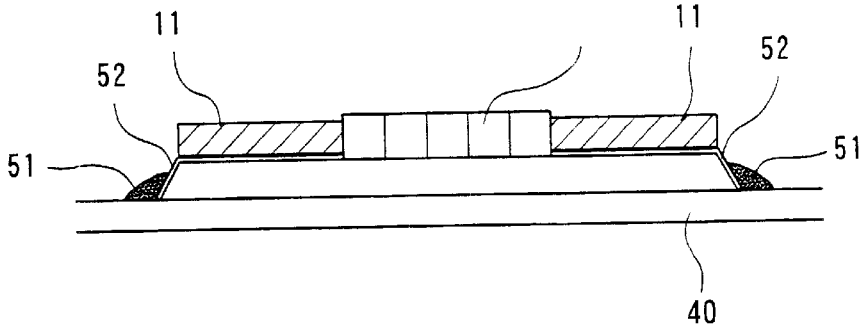

FIGS. 16A and 16B show another embodiment of the invention, in which the structure and shape of the welding pad which is shown in FIGS. 15A to 15D are modified. In this modification, a support member 20 which has conductive patterns 21 as similar as in the structure of FIG. 14A is provided with three lugs 52 which extend at and from the opposed ends of the support member 20 as illustrated. The lugs 52 are then bent downwardly to form supporting legs and thus formed support member 20 is placed on the substrate 40. The lugs 52 are connected with the substrate 40 by providing solder 51 on an outer portion of the lugs 52. In this embodiment, three lugs 52 are provided by the same reasons as the provision of the three projections 50 in the embodiment of FIG. 15A so that center of gravity of the three lugs 52 becomes coincident to the center of gravity of the device itself, although coincidence of the centers of gravity in the embodiment of FIG. 16A is more difficult than the embodiment of FIG. 15A. However, in the embodiment of FIGS. 16A and 16B, since the solder is provided on the outer portion of the lugs 52, there is an advantage that the soldering can be carried out by visual inspection. Reference numeral 11 represents a core which is similar as the core 11 in the previous embodiments and inserted into the conductive patterns 21 in the similar manner.

Although preferred embodiments of the present invention have been described above, the present invention is not limited thereto, i.e., various types of modifications can be made.

For example, in the embodiment of FIGS. 10A to 10C, solder pads are formed on only the portions of the support member which are close to the initial and final turns (winding portions), but the solder pad can be provided on each of the portions of the support member 20 which are close to all turns so that the number of turns can be regulated arbitrarily by changing the number of soldering portions on a mounting substrate (not shown).

It is also possible, though not shown, to provide claws integral with a support member 20 by utilizing the technical concept of the embodiment of FIGS. 6A to 6C, or paste sheets as gap regulating sheets on a support member 20, so that both a core positioning operation and a gap regulating operation can be carried out.

Furthermore, although an illustration is omitted, it is also possible to employ a double-faced substrate as a support member. When in this case separate windings are provided on first and second surfaces, a degree of coupling of the windings can be increased. When the first and second surfaces are parallel-connected via a via-hole (through hole), a structure adaptable to a large current can be formed.

According to the present invention described above, it is possible to eliminate various drawbacks encountered in a related art inductor, reduce the manday of the windings, and provide a novel inductor of a structure adaptable to surface mounting techniques.

To be exact, it is possible to simplify a step of forming windings of, especially, a small-sized high power inductor, and provide an inductor of a simple structure at a low cost. Moreover, in a mode of embodiment in which conductors are connected together by employing cooperative actions of simple slits and claws, an inductor capable of forming a simple winding structure can be provided.

In a structure according to the present invention obtained by forming conductors of a desired shape on a foldable plate type support member, providing slits in one end of the conductors and claws on the other end thereof, forming windings and a opening by folding the plate type support member and thereby engaging the slits and claws with each other, and inserting a magnetic core through the opening, a winding forming step for, especially, a small-sized high power inductor can be simplified greatly. This enables the cost to be reduced, and the inductor to be adapted to the surface mounting techniques very easily.

In the structure of an inductor obtained by forming conductors on rectangular parallelopipedal support members provided with openings, through which magnetic cores are inserted, between opposite surfaces of the support members with respect to one of three axial directions thereof, and engaging end portions of the conductors with each other in a plane perpendicular to the direction in which the conductors are formed, to connect the conductors together and thereby form windings, a winding forming step for, especially, a small-sized high power inductor can be simplified greatly, so that it becomes possible to reduce the cost and adapt the inductor to the surface mounting techniques very easily.

In the structure in which the magnetic cores are covered with the windings provided on the support members, the horizontal positioning of the windings and magnetic cores can be done, and easily at that.

Since the winding structure is formed by connecting the conductors together by engaging with each other the slits provided in the support members and claws provided on one end of the conductors, the connection of the conductors can be attained by a very simple structure.

In the structure in which groove-carrying bands are formed on the support members as guides for horizontally positioning the windings and magnetic cores, a positioning operation can be carried out easily.

Moreover, owing to the claws provided on the support members and the soldering of a mounting substrate, the number of turns can be arbitrarily regulated.

Since the connection of the conductors is carried out on the outer surfaces of the magnetic cores, the assembling operation for the manufacturing of the inductor can be carried out easily.

In the structure using parts of the support members also as gap regulating sheets, the construction of the inductor can be simplified.

In the structure in which gap-regulating sheets are pasted in advance on the support members, the positioning of the magnetic cores and a gap regulating operation can be carried out simultaneously.

The structure obtained by forming openings in flexible support members, forming conductors (patterns) along the openings, folding the support members along the openings to form windings, and putting together the openings of the folded support members so that magnetic cores can be inserted through the openings enables the formation of an inductor having a high degree of selecting the number of turns, capable of being adapted to surface mounting techniques, and having a simple construction.

In this structure in which the support members are folded at the portions thereof which are between adjacent openings, the number of turns can be arbitrarily increased.

In the structure in which the support members are folded at the portions thereof which are between adjacent openings along the edges thereof, the height of the upper surf aces of turns can be reduced.

It is possible to provide cut and raised openings at both side portions of the support members and thereby carry out the positioning of the windings and magnetic cores.

In the structure in which a pair of opposed groove-carrying bands are provided on the support members, the engaging of the groove-carrying bands with each other enables the horizontal positioning of the windings and magnetic cores to be done simply.

In addition to the above, in the structure that the flexible support member is unitarily formed with the conductor having a predetermined pattern and in the structure that projections are formed for soldering purposes relative to the printed circuit board (FIGS. 14A through 15D), the winding step can be simplified and the thus formed inductor can meet with requirements for surface mounting. Particularly in case of a power inductor of a reduced height type, the winding step can be simplified and the connection between the windings can be made collectively. Consequently, reduction of production cost can be realized as well as enhancement of easy application for surface mounting.

What is claimed is:

1. A method of making an inductor comprising:

forming conductors on bendable plate type support members, each conductor having a first end and a second end;

providing a slit in the first end of each conductor;

providing a claw on the second end of each conductor;

bending the plate type support members; and engaging the slit and claw of each conductor with each other to form windings on, and magnetic core inserting openings in, the support members.

2. An inductor comprising:

bendable plate type support members;

conductors formed on the bendable plate type support members, each of the conductors having a first end and a second end;

a slit disposed in the first end of each conductor; and a claw disposed on the second end of each conductor, wherein said bendable plate type support members are capable of being bent such that said slit and said claw of each conductor engage with each other, such that windings are formed on said bendable plate type support members and such that magnetic core inserting openings are formed in said bendable plate type support members.

3. An inductor comprising:

rectangular parallelopipedal support members having openings capable of having magnetic cores inserted therethrough; and a conductor on each of said rectangular parallelopipedal support members, said conductors being provided between opposite surfaces of said rectangular parallelopipedal support members with respect to one of three axial directions of said rectangular parallelopipedal support members, wherein end portions of said conductors are capable of being engaged with each other in a plane perpendicular to a direction of formation of said conductors so that said conductors are capable of being connected together to thereby form windings, wherein each of said conductor has a slit provided therein and a claw provided therein, and wherein said windings comprise an engagement of said conductors by a locking together of said slit and said claw, of each conductor, with each other.

4. An inductor comprising:

rectangular parallelopipedal support members having openings for inserting therethrough magnetic cores; and a conductor on each said rectangular parallelopipedal support member, said conductors being provided between opposite surfaces of said rectangular parallelopipedal support members with respect to one of three axial directions of said rectangular parallelopipedal support members, wherein end portions of said conductors are capable of being engaged with each other in a plane perpendicular to a direction of formation of said conductors so that said conductors are capable of being connected together to thereby form windings, wherein said conductors are arranged in a number of turns, wherein each said conductor support member has a claw located therein, and wherein the number of turns is capable of being set arbitrarily by soldering said claws provided on said support members and a mounting substrates together.

5. An inductor comprising:

rectangular parallelopipedal support members having openings for inserting therethrough magnetic cores;

a conductor on each of said rectangular parallelopipedal support members, said conductors being provided between opposite surfaces of said rectangular parallelopipedal support members with respect to one of three axial directions of said rectangular parallelopipedal support members; and a sheet disposed on one of said support members, wherein end portions of said conductors are capable of being engaged with each other in a plane perpendicular to a direction of formation of said conductors so that said conductors are capable of being connected together to thereby form windings, and wherein said sheet is capable of simultaneously positioning magnetic cores within said support members and regulating a gap between two of said support members.

6. An inductor comprising:

flexible support members having openings; and conductors formed along the openings, wherein said flexible support members are folded along the openings to form windings and permit a magnetic core to be inserted through the openings of said folded support members, and wherein cut and raised openings are provided in side portions of said support members to enable positioning of the windings and magnetic cores.

7. An inductor comprising:

flexible support members having openings;

conductors formed along the openings; and a pair of opposed groove-carrying bands, one band being located on each support member, wherein said flexible support members are folded along the openings to form windings and permit a magnetic core to be inserted through the openings of said folded support members, wherein said groove-carrying bands are engaged with each other to enable horizontal positioning of the windings and magnetic cores.

8. An inductor comprising:

bendable support members having opening therein;

conductors disposed on said bendable support members; and magnetic cores, wherein said bendable support members are bent so as to form winding portions with the openings being located in said winding portions, wherein said magnetic cores are disposed through the openings, wherein each said bendable support member has a projection formed thereon, wherein each projection is capable of being welded to a printed circuit board, and wherein each projection comprises an indentation of one of said conductors.

9. An inductor according to claim 8, wherein each projection comprises a recess and an adhesive agent disposed in the recess so that said magnetic cores and said winding portions are fixed together.

10. An inductor according to claim 8, wherein said projections are provided at three portions on each supporting member.

11. An inductor according to claim 10, wherein a center of gravity of said projections coincides with a center of gravity of said inductor.

12. An inductor according to claim 8, wherein said conductors and said projections are arranged such that the connection between said conductors can be selected between a serial connection and a parallel connection.

* * * * *